US006526891B2

(12) United States Patent
Ehmig

(10) Patent No.: US 6,526,891 B2
(45) Date of Patent: Mar. 4, 2003

(54) CARTRIDGE FOR SETTING DEVICES

(75) Inventor: Gerhard Ehmig, Rankweil (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/728,290

(22) Filed: Dec. 1, 2000

(65) Prior Publication Data

US 2001/0002572 A1 Jun. 7, 2001

(30) Foreign Application Priority Data

Dec. 4, 1999 (DE) ..... 199 58 571

(51) Int. Cl.[7] ..... F42B 39/08; F42B 5/30
(52) U.S. Cl. ..... 102/467; 89/35.01; 102/466
(58) Field of Search ..... 89/35.01; 102/466, 102/467, 430, 281

(56) References Cited

U.S. PATENT DOCUMENTS 4,819,562 A * 4/1989 Bowman ..... 102/281
4,920,885 A * 5/1990 Bowman et al. ..... 102/281
5,036,746 A * 8/1991 Ehmig et al. ..... 102/470
5,279,201 A * 1/1994 Jena et al. ..... 102/466
5,492,065 A * 2/1996 Jena et al. ..... 102/281

* cited by examiner

*Primary Examiner*—Charles T. Jordan
*Assistant Examiner*—John W. Zerr
(74) *Attorney, Agent, or Firm*—Sidley Austin Brown & Wood, LLP

(57) ABSTRACT

A cartridge for setting devices if formed of a pot-shaped plastics material cartridge housing (2), which has a surface (8) contacting the inner contour (12) of a cartridge chamber of the setting device. A sealing cover (3) closes off the housing (2) at its open end (4). The sealing cover (3) has a cylindrical section (6), which extends into the interior (5) of the housing (2) and expands under the pressure developed upon ignition of the cartridge, so that a positive connection results between the housing (2) and the sealing cover (3).

9 Claims, 3 Drawing Sheets

CARTRIDGE FOR SETTING DEVICES

FIELD OF INVENTION

The invention relates to a cartridge for setting devices, consisting of a pot-shaped plastics material housing having a surface, which comes into contact with the inner contour of the cartridge chamber in the setting device, and a sealing cover, which closes off the open end of the seating body, and a cylindrical section, which protrudes into the interior of the housing.

BACKGROUND OF THE INVENTION

Cartridges of the type mentioned are used in setting devices, especially in powder force-driven setting devices, of different types. In order to achieve as high an economic efficiency as possible, plastics material is advantageously used to produce such cartridges. In the event that cartridges of this type, which are connected with one another to form magazine strips, are used, a more rapid setting cycle is achieved than in the case of setting devices, operated with individual cartridges. It is important that individual cartridges, as well as cartridges connected together into a magazine strip, are constructed so that operational malfunctions of the setting device, such as those when parts or residues of the cartridges remain behind in the cartridge chamber of the setting device, cannot occur.

A cartridge of the aforementioned type is disclosed, for example, in EP 0525613 B1. This known cartridge consists of a pot-shaped, plastics material housing and a sealing cover, which closes off housing at its open end, and of a cylindrical section, which protrudes into the interior of the housing. The opening of the housing has an edge strip, which has undercuts, in which the correspondingly-shaped side edges of the sealing cover lock, on the mutually facing inner surfaces.

It is a disadvantage of the known cartridge that the connection between the sealing cover and the housing sometimes is inadequate. For example, it is possible that, due to the deformations arising during the ignition of the cartridge, the sealing cover falls off the housing, so that malfunctions in the setting device are caused. As a result, the setting device has to be dismantled, which takes considerable time. Especially in the case of setting devices for serial applications, where cartridges, connected into magazine strips, are used, such malfunctions have a serious effect.

It is a further disadvantage of this known solution that the manufacture of such a cartridge with a snap mechanism is not economic, since the undercuts in the housing as well as in the sealing cover make additional steps necessary in the production of the cartridge and require a greater expenditure for tools.

OBJECT OF THE INVENTION

It is an object of the invention to provide a cartridge, which can be used trouble-free in setting devices independently of the respective pressure relationships. In addition, it is possible to manufacture the cartridge economically.

SUMMARY OF THE INVENTION

Pursuant to the invention, this objective is accomplished owing to the fact that the housing has at least one recess in the region of its surface at a distance from its open end and at least partially in the radial projection region of the cylindrical section of the sealing cover.

Owing to the fact that a relatively high pressure and a high temperature, in comparison to the surroundings, result in the interior of the housing during the ignition of the cartridge, the housing is deformed. During this deformation, the inner contour of the cartridge chamber forms a limitation in the form of a die. In the regions, which are bounded by the unchanged surface, there is practically no deformation of the housing. In the region of the recess, the latter is filled at least partially and the interior of the housing is consequently expanded. Since the recess is at least partially in the radial projection region of the cylindrical section of the sealing cover, this leads to an at least partial radial expansion of the interior of the housing in the radial projection region of the cylindrical section of the sealing cover. The cylindrical section of the sealing cover yields under the pressure and the high temperature and expands radially in the same region. Owing to the fact that the recess is disposed at a distance from the opening of the housing, a region, which is expanded less radially, remains between the region, expanded radially by the ignition of the cartridge, and the opening of the housing. Both regions together form a positive locking between the housing and the sealing cover, which prevents the sealing cover falling out during the ignition of the cartridge.

Viewed in the radial direction, the recess can be disposed anywhere. Preferably, however, it is open towards the outer periphery of the housing, since this is helpful for producing it economically.

From the point of view of the production of the cartridges and the deformation behavior of housing and sealing covers, the recess advisably is constructed in the shape of a wedge.

An axial length of the recess, which corresponds to 0.2 to 0.8 times the diameter of the cylindrical section, has proven to be particularly advantageous for an optimum positive connection between the housing and the sealing cover.

So that the deformation relationships are optimum, the depth of the recess, measured radially, preferably corresponds to 0.05 to 0.2 times the diameter of the cylindrical section. Under these conditions, a good positive connection between the housing and the sealing cover is assured and there is no overstressing of any material, such as the sealing cover during the ignition of the cartridge.

In order to ensure that a possible falling out of the sealing cover during the ignition of the cartridge in the axial direction is counteracted by adequate resistance, the recess is advisably disposed at a distance, which corresponds to 0.1 to 0.5 times the diameter of the cylindrical section.

The recess preferably extends over at least a portion of the periphery of the housing in order to achieve the best possible connection between the sealing cover and the housing. In particular, when the recess extends over the whole of the periphery of the housing, the deformation due to the annular expansion, which is uniform over the whole of the periphery, has an optimum effect on the positive connection.

In order to achieve the best possible centering of the sealing cover, for example, also during the installation, the axial length of the cylindrical section preferably corresponds to 0.2 to 0.6 times the diameter of the cylindrical section.

To ensure that the manufacturing process is as cost-effective as possible and achieves adequate stability of the sealing cover, the latter, pursuant to the invention, preferably is made from a metal, such as steel or brass.

In accordance with a further proposal of the invention, several cartridges are connected with one another into a magazine strip, so that the cartridges can be supplied automatically and, with that, a setting cycle, which is more rapid than that of singly supplied cartridges, becomes possible.

The invention is described in greater detail below by means of an example and a drawing, in which

DETAILED DESCRIPTION OF THE INVENTION

Figure 1:
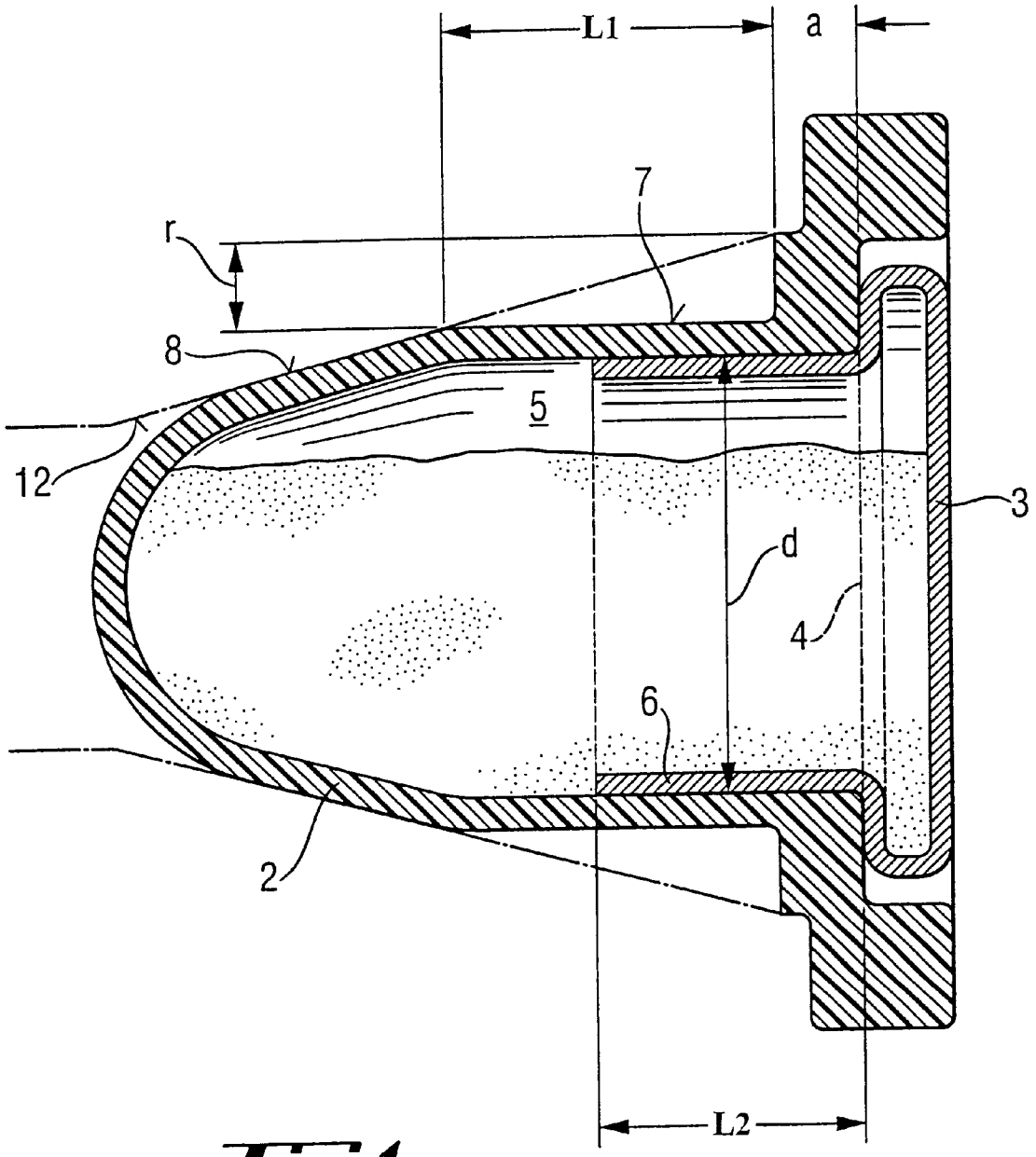
FIG. 1 shows a cartridge, embodying the present invention, in longitudinal section.
Figure 2:
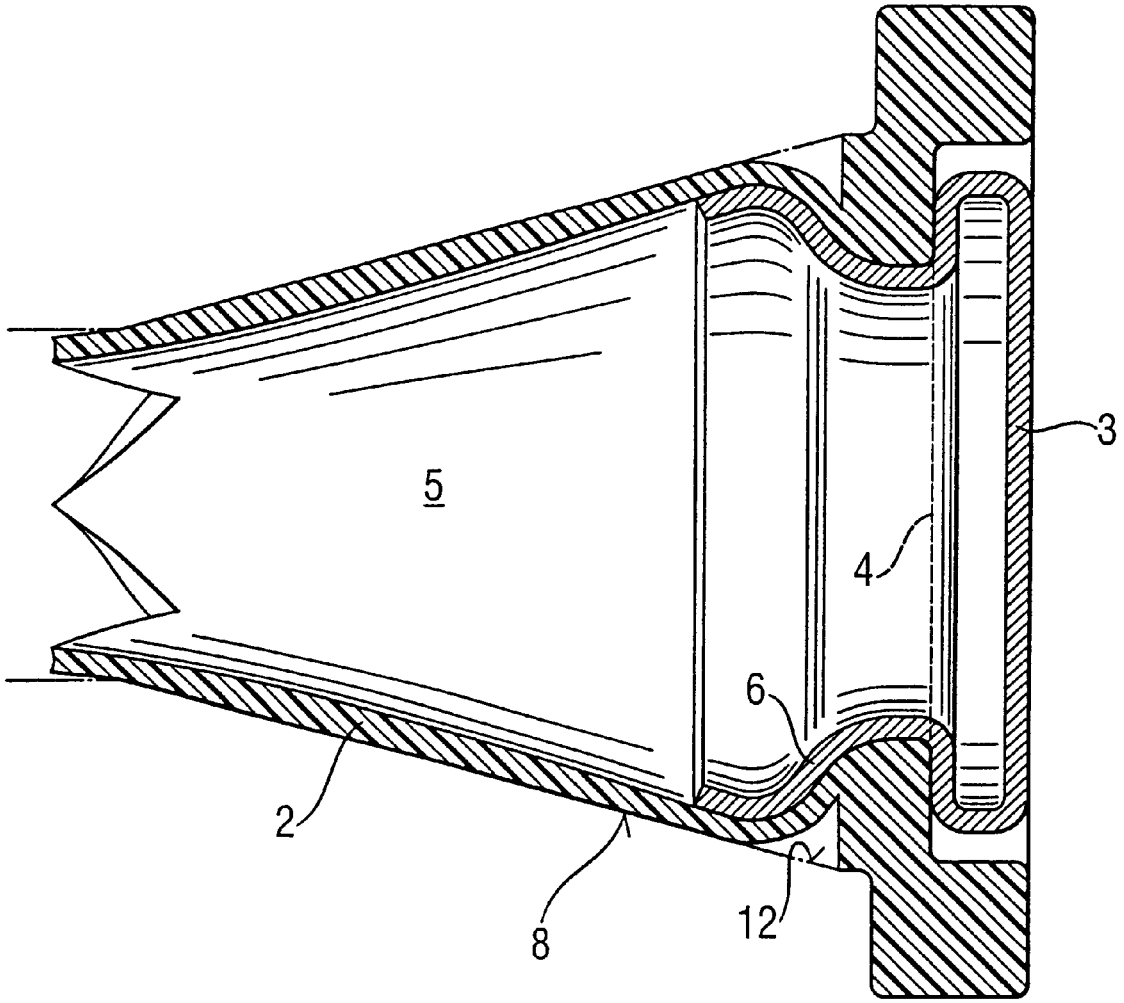
FIG. 2 shows the cartridge of FIG. 1 after ignition.

FIGS. 1 and 2 show a longitudinal section of a cartridge, consisting of a pot-shaped plastics material cartridge housing 2 and a sealing cover 3, preferably of metal. The housing 2 has an open end 4, which is closed off by the sealing cover 3, so that an internal space 5 is formed. The sealing cover 3 has a cylindrical section 6, which protrudes into the internal space 5 of the housing 2 and has an outside diameter d and a length L2. At the surface 8 of the housing 2, coming in contact with an inner surface 12 (indicated by a line) of the cartridge chamber of a setting device, which has not been shown, an axially extending recess 7 is disposed at least partially in the radial outer projection region of the cylindrical section 6 of the sealing cover 3 at a distance a from the open end 4. Preferably, the housing 2 has a cylindrical section laterally enclosing and contacting the outer surface of the cylindrical section 6 and forms, relatively to the inner surface 12 of the cartridge chamber, the recess 7 open towards the inner surface 12, shaped in the form of a wedge with an axial length L1 and constructed with a maximum radial depth r. The recess 7 extends, for example, around the full outer periphery of the housing 2.

The inventive cartridge, after ignition, is shown in FIG. 2. It can be seen how the recess 7, extending around the whole periphery of the cartridge, is filled after the ignition of the cartridge and, by these means, a radial expansion of the interior 5 of the housing 2 results. In the region along a length of the stepped portion of the housing 2, at the open end 4, there is practically no radial expansion. The section 6 of the sealing cover 3, which is cylindrical before the ignition of the cartridge, expands and fits the newly formed inner contour of the housing. By these means, a positive connection is formed between the housing 2 and the sealing cover 3, which prevents the sealing cover 3 from falling out when the cartridge is ignited.

Figure 3:
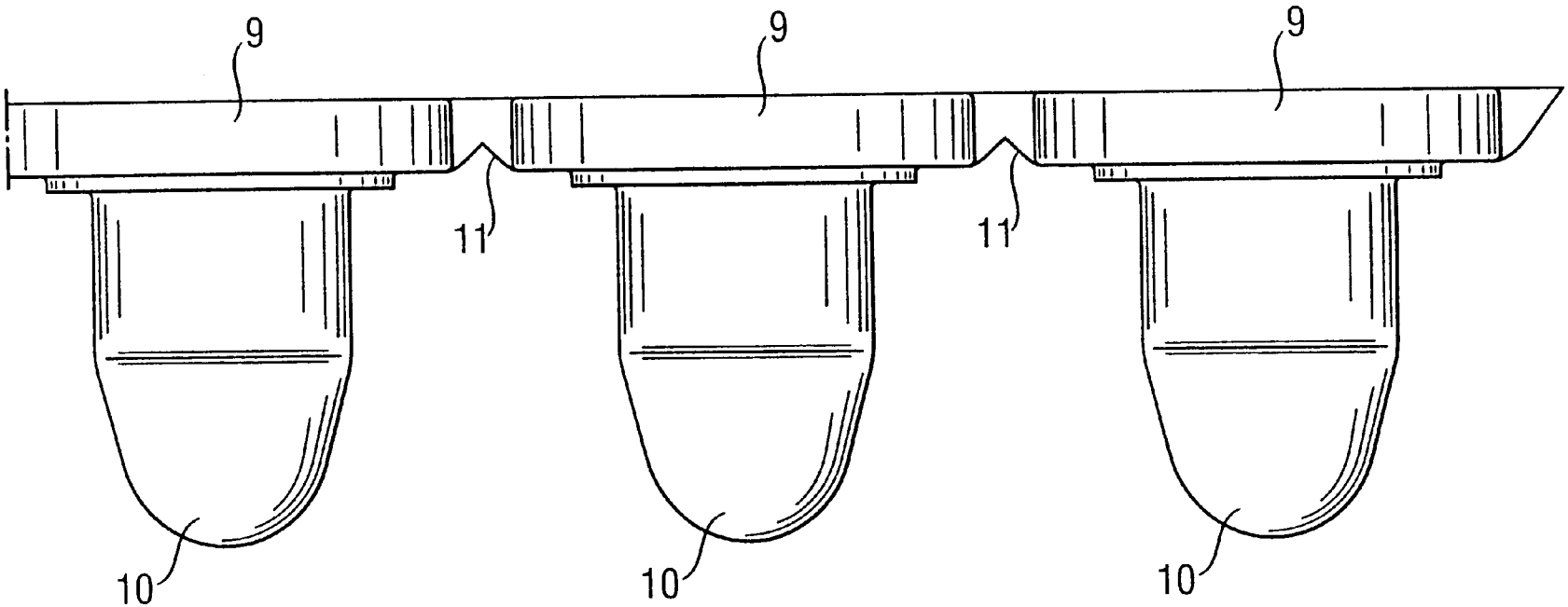
FIG. 3 shows a side view of cartridges combined with one another into a magazine strip.

FIG. 3 shows a side view of several cartridges, which are combined into a magazine strip. The magazine strip has a seating body strip 9, preferably formed of plastics material, to which cartridge housings 10 are integrally molded. Moreover, the strip 9 is provided with predetermined breaking points 11.

What is claimed is:

1. A cartridge for a setting device, comprising a pot-shaped plastics material cartridge housing (2, 10), which has an outer surface (8) for contact with an inner surface (12) of a cartridge chamber of the setting device, said cartridge having an open end and a closed end and an open end-closed end direction and a sealing cover (3) for closing off said open end (4) of the housing (2, 10), said sealing cover (3) has a cylindrical section (6), extending into an interior (5) of the housing (2, 10) with an outer surface thereof in surface contact with an inner surface of said housing (2, 10), said cylindrical section (6) has an outside diameter (d) wherein the housing (2, 10), in a region of the surface (8), has a section extending in the open end-closed end direction and at least in part enclosing and in contact with said cylindrical section (6), at least one recess (7) formed between said outer surface (8) and the cartridge chamber at a distance (a) spaced in the open end-closed end direction from the open end (4) of the housing and extending at least partially in a radial projection region of the cylindrical section (6), said recess (7) being continuous in the open end-closed end direction and the recess (7) extending in the open end-closed end direction and is an open space outwardly from the outer surface (8) of the housing (2, 10) to the inner surface (12) of the cartridge chamber so that upon ignition of said cartridge a section of said cylindrical section (6) and of said housing (2, 10) spaced by the distance (a) from the open end (4) is expanded radially outwardly into positive locking action between the housing (2, 10) and the sealing cover (3) in at least a partial section of said cylindrical section (6) extending in the open end-closed end direction with said inner surface (12) in the open end-closed direction of said recess (7).

2. A cartridge, as set forth in claim 1, wherein the recess (7) is wedge-shaped in the open end-closed end direction.

3. A cartridge, as set forth in claim 1, wherein the recess has an axial length (L1) in the range of 0.2 to 0.8 times the diameter (d) of the cylindrical section (6).

4. A cartridge, as set forth in claim 1, wherein a maximum radially measured depth (r) of the recess (7) corresponds to 0.05 to 0.2 times the diameter (d) of the cylindrical section (6).

5. A cartridge as set forth in claim 1, wherein said distance (a) of the recess from the open end (4) of said housing (2) is in the range of 0.1 to 0.5 times the diameter (d) of the cylindrical section (6).

6. A cartridge, as set forth in claim 1, wherein the recess (7) of the housing (2, 10) extends at least around a portion of an outer periphery of the surface (8).

7. A cartridge as set forth in claim 1, wherein an axial length (L2) of the cylindrical section (6) is in the range of 0.2 to 0.6 times the diameter of the cylindrical section (6).

8. A cartridge, as set forth in claim 1, wherein the sealing cover (3) consists of metal.

9. A cartridge, as set forth in claim 1, wherein a magazine strip is formed of a plastic material elongated sealing body strip (9) with said cartridge housings (2, 12) integrally molded therewith in a spaced apart relation and said strip (9) having predetermined breaking points (11) spaced between said cartridges housing (2, 12).

* * * * *